US006546369B1

(12) United States Patent
Buth et al.

(10) Patent No.: US 6,546,369 B1
(45) Date of Patent: Apr. 8, 2003

(54) TEXT-BASED SPEECH SYNTHESIS METHOD CONTAINING SYNTHETIC SPEECH COMPARISONS AND UPDATES

(75) Inventors: Peter Buth, Bochum (DE); Frank Dufhues, Bochum (DE)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/564,787

(22) Filed: May 5, 2000

(30) Foreign Application Priority Data

May 5, 1999 (DE) ..... 199 20 501

(51) Int. Cl.[7] ..... G10L 13/00
(52) U.S. Cl. ..... 704/275; 704/260; 704/270
(58) Field of Search ..... 704/260, 270, 704/275

(56) References Cited

U.S. PATENT DOCUMENTS 5,029,200 A * 7/1991 Haas et al. ..... 379/89
5,913,193 A * 6/1999 Huang et al. ..... 704/258
6,005,549 A * 12/1999 Forest ..... 345/157
6,081,780 A * 7/2000 Lumelsky ..... 704/260
6,163,769 A * 12/2000 Acero et al. ..... 704/260
6,173,263 B1 * 1/2001 Conkie ..... 704/260
6,266,638 B1 * 7/2001 Stylianou ..... 704/266

* cited by examiner

*Primary Examiner*—Susan McFadden
(74) *Attorney, Agent, or Firm*—Antonelli, Terry, Stout & Kraus, LLP

(57) ABSTRACT

The invention specifies a simple reproduction method with improved pronunciation for voice-controlled systems with text-based speech synthesis even when the stored train of characters to be synthesized does not follow the general rules of speech reproduction. According to the invention, the method of "copying" the original spoken input text into the otherwise synthesized reproduction text, which is the current state of the art, is avoided, which will significantly increase the acceptance of the user of the voice-controlled system due to the process invented. More specifically, when there is actual spoken speech input that corresponds to a stored train of characters, the converted train of characters is compared to the speech input before reproduction of the train of characters described phonetically according to general rules and converted to a purely synthetic form. When the converted train of characters is found to deviate from the speech input by a value above a threshold value, at least one variation of the converted train of characters is created. This variation is then output instead of the converted train of characters as long as this variation deviates from the speech input by a value below the threshold value.

23 Claims, 2 Drawing Sheets

TEXT-BASED SPEECH SYNTHESIS METHOD CONTAINING SYNTHETIC SPEECH COMPARISONS AND UPDATES

FIELD OF THE INVENTION

The invention relates to the improvement of voice-controlled systems with text-based speech synthesis, in particular with the improvement of the synthetic reproduction of a stored trail of characters whose pronunciation is subject to certain peculiarities.

BACKGROUND OF THE INVENTION

The use of speech to operate technical devices is becoming increasingly important. This applies to data and command input as well as to message output. Systems that utilize acoustic signals in the form of speech to facilitate communication between users and machines in both directions are called voice response systems. The utterances output by such systems can be prerecorded natural speech or synthetically created speech, which is the subject of the invention described in this document. There are also devices known in which such utterances are combinations of synthetic and prerecorded natural language.

A few general explanations and definitions of speech synthesis will be provided in the following to gain a better understanding of the invention.

The object of speech synthesis is the machine transformation of the symbolic representation of an utterance into an acoustic signal that is sufficiently similar to human speech that it will be recognized as such by a human.

Systems used in the field of speech synthesis are divided into two categories:

1) A speech synthesis system produces spoken language based on a given text.
2) A speech synthesizer produces speech based on certain control parameters.

The speech synthesizer therefore represents the last stage of a speech synthesis system.

A speech synthesis technique is a technique that allows you to build a speech synthesizer. Examples of speech synthesis techniques are direct synthesis, synthesis using a model and the simulation of the vocal tract.

In direct synthesis, parts of the speech signal are combined to produce the corresponding words based on stored signals (e.g. one signal is stored per phoneme) or the transfer function of the vocal tract used by humans to create speech is simulated by the energy of a signal in certain frequency ranges. In this manner vocalized sounds are represented by the quasi-periodic excitation of a certain frequency.

The term 'phoneme' mentioned above is the smallest unit of language that can be used to differentiate meanings but that does not have any meaning itself. Two words with different meanings that differ by only a single phoneme (e.g. fish/wish, woods/wads) create a minimal pair. The number of phonemes in a language is relatively small (between 20 and 60). The German language uses about 45 phonemes.

To take the characteristic transitions between phonemes into account, diphones are usually used in direct speech synthesis. Simply stated, a diphone can be defined as the space between the invariable part of the first phoneme and the invariable part of the second phoneme.

Phonemes and sequences of phonemes are written using the International Phonetic Alphabet (IPA). The conversion of a piece of text to a series of characters belonging to the phonetic alphabet is called phonetic transcription.

In synthesis using a model, a production model is created that is usually based on minimizing the difference between a digitized human speech signal (original signal) and a predicated signal.

The simulation of the vocal tract is another method. In this method the form and position of each organ used to articulate speech (tongue, jaws, lips) is modeled. To do this, a mathematical model of the airflow characteristics in a vocal tract defined in this manner is created and the speech signal is calculated using this model.

Short explanations of other terms and methods used in conjunction with speech synthesis will be given in the following.

The phonemes or diphones used in direct synthesis must first be obtained by segmenting the natural language. There are two approaches used to accomplish this:

In implicit segmentation only the information contained in the speech signal itself is used for segmentation purposes.

Explicit segmentation, on the other hand, uses additional information such as the number of phonemes in the utterance.

To segment an utterance, features must first be extracted from the speech signal. These features can then be used as the basis for differentiating between segments.

These features are then classified.

Possible methods for extracting features are spectral analysis, filter bank analysis or the linear prediction method, amongst others.

Hidden Markov models, artificial neural networks or dynamic time warping (a method for normalizing time) are used to classify the features, for example.

The Hidden Markov Model (HMM) is a two-stage stochastic process. It consists of a Markov chain, usually with a low number of states, to which probabilities or probability densities are assigned. The speech signals and/or their parameters described by probability densities can be observed. The intermediate states themselves remain hidden. HMMs have become the most widely used models due to their high performance and robustness and because they are easy to train when used in speech recognition.

The Viterbi algorithm can be used to determine how well several HMMs correlate.

More recent approaches use multiple self-organizing maps of features (Kohon maps). This special type of artificial neural network is able to simulate the processes carried out in the human brain.

A widely used approach is the classification into voiced/unvoiced/silence in accordance with the various excitation forms arising during the creation of speech in the vocal tract.

Regardless of which of the synthesis techniques are used, a problem still remains with text-based synthesis devices. The problem is that even if there is a relatively high degree of correlation between the pronunciation of a text or stored train of characters, there are still words in every language whose pronunciation cannot be determined from the spelling of the word if no context is given. In particular, it is often impossible to specify general phonetic pronunciation rules for proper names. For example, the names of the cities "Itzehoe" and "Laboe" have the same ending, even though the ending for Itzehoe is pronounced "oe" and the ending for Laboe is pronounced "ö". If these words are provided as trains of characters for synthetic reproduction, then the application of a general rule would lead to the endings of both city names in the example above being pronounced either "ö" or "oe", which would result in an incorrect pronunciation when the "ö" version" is used for Itzehoe and when the "oe" version is used for Laboe. If these special cases are to be taken into consideration, then it is necessary to subject the corresponding words of that language to special treatment for reproduction. However, this also means that it is not possible anymore to use pure text-based input for any words intended to be reproduced later on.

Due to the fact that giving certain words in a language special treatment is extremely complex, announcements to be output by voice-controlled devices are now made up of a combination of spoken and synthesized speech. For example, for a route finder, the desired destination, which is specified by the user and which often displays peculiarities in terms of its pronunciation as compared to other words in the corresponding language, is recorded and copied to the corresponding destination announcement in voice-controlled devices. For the destination announcement "Itzehoe is three kilometers away", this would cause the text written in cursive to be synthesized and the rest, the word "Itzehoe", to be taken from the user's destination input. The same set of circumstances also arises when setting up mail boxes where the user is required to input his or her name. In this case, in order to avoid these complexities the announcement played back when a caller is connected to the mailbox is created from the synthesized portion "You have reached the mailbox of" and the original text, e.g. "John Smith", which was recorded when the mailbox was set up.

Apart from the fact that combined announcements of the type just described leave a more or less unprofessional impression, they can also lead to problems when listening to the announcement due to the inclusion of recorded speech in the announcement. We only need to point out the problems arising in conjunction with inputting speech in noisy environments. That is why the invention is the result of the task of specifying a reproduction process for voice-controlled systems with text-based speech synthesis in which the disadvantages inherent in the current state of the art are to be eliminated.

SUMMARY OF THE INVENTION

This task will be accomplished using the features of the present invention. Advantageous extensions and expansions of the invention are also provided. If, in accordance with the present invention, there is actual spoken speech input corresponding to a stored string of characters and a train of characters that has been described phonetically according to general rules and converted to a purely synthetic form is compared to the spoken speech input before the actual reproduction of the converted train of characters, and the converted train of characters are actually reproduced only after a comparison of this train of characters with the actual spoken speech input results in a deviation that is below a threshold value, then the use of the original recorded speech for reproduction, corresponding to the current state of the art, is superfluous. This even applies when the spoken word deviates significantly from the converted train of characters corresponding to the spoken word. It must only be ensured that at least one variation is created from the converted train of characters, and that the variation created is output instead of the—original-converted train of characters if this variation displays a deviation below the threshold value when compared to the original speech input.

If the method of the present invention is performed, then the amount of computational and memory resources required remains relatively low. The reason for this is that only one variation must be created and examined.

If at least two variations are created in accordance with the present invention and the variation with the lowest deviation from the original speech input is determined and selected, then, in contrast to performing the method of the present invention as described above, there is always at least one synthetic reproduction of the original speech input possible.

Performing the method is made easier when the speech input and the converted train of characters or the variations created from it are segmented. Segmentation allows segments in which there are no deviations or in which the deviation is below a threshold value to be excluded from further treatment.

If the same segmenting approach is used, the comparison becomes especially simple because there is a direct association between the corresponding segments.

As per the present invention, different segmenting approaches can be used. This has its advantages, especially when examining the original speech input, because the information contained in the speech signal, which can only be obtained in a very complex step, must be used in any case for segmentation, while the known number of phonemes in the utterance can simply be used to segment trains of characters.

The method of the present invention becomes very efficient when segments with a high degree of correlation are excluded, and only the segment of the train of characters that deviates from its corresponding segment in the original speech input by a value above the threshold value is altered by replacing the phoneme in the segment of the train of characters with a replacement phoneme.

The method of the present invention is especially easy to perform when for each phoneme there is at least one replacement phoneme similar to the phoneme that is linked to it or placed in a list.

The amount of computation is further reduced when the peculiarities arising in conjunction with the reproduction of the train of characters for a variation of a train of characters determined to be worthy of reproduction are stored together with the train of characters. In this case the special pronunciation of the corresponding train of characters can be accessed in memory immediately when used later or without much additional effort.

DETAILED DESCRIPTION OF THE PREFERRED EMBODIMENTS OF THE INVENTION

The invention will now be explained in more detail based on the two figures.

To better present the effect of the invention, we will assume that we are using a voice-controlled system with text-based speech synthesis. Such systems are implemented in route finders or mailbox devices so that the illustrations of such systems can be restricted to those things that are absolutely necessary to explain the invention due to the widespread use of such systems.

All of these systems have a memory in which a large number of trains of characters are stored. The trains of characters could be street or city names, for example, for a route finder. In a mailbox application the trains of characters may be the names of persons with mailboxes, so the memory is similar to a telephone book. The trains of characters are provided as text so that memory can be easily loaded with the corresponding information or so that the stored information can be easily updated.

Figure 1:
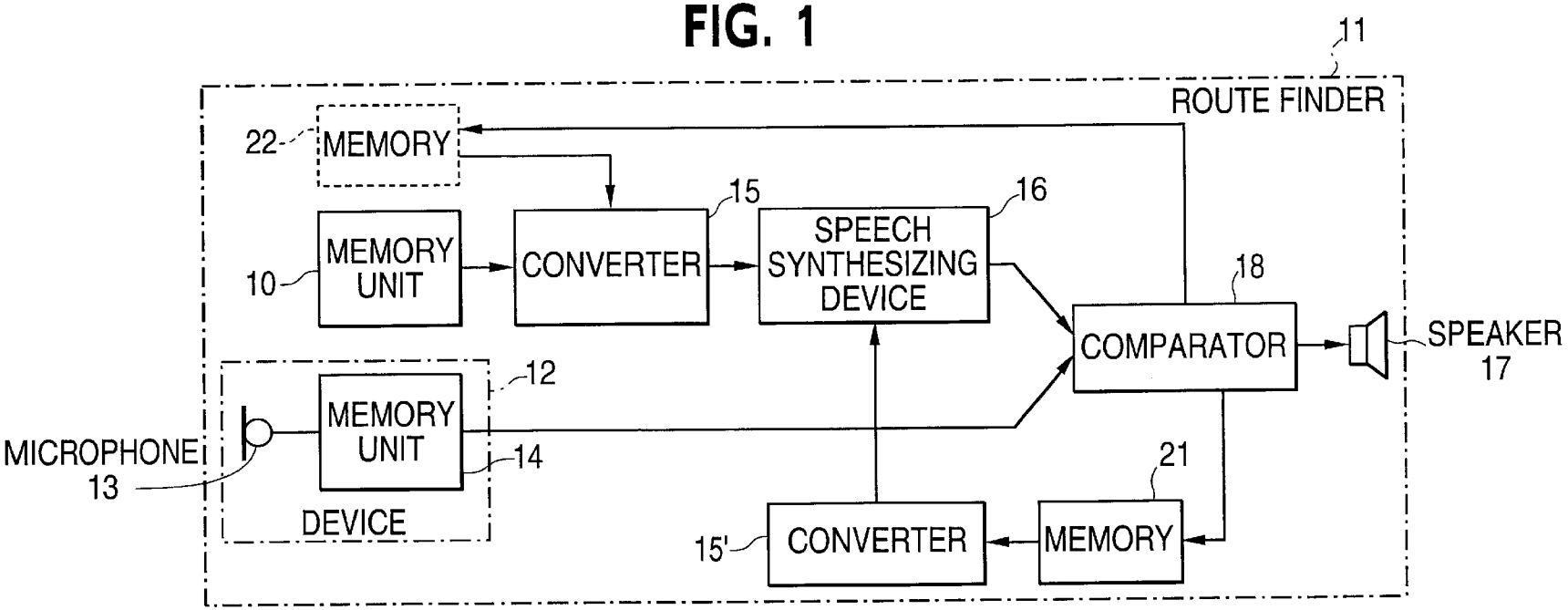
FIG. 1: An illustration of the process according to the invention

In FIG. 2, which shows an illustration of the process according to the invented method, such a memory unit is labeled 10. Memory Unit 10, which is to contain the names of German cities to illustrate the invention, belongs to Route Finder 11. In addition, Route Finder 11 contains Device 12, which can be used to record speech input and store it temporarily. As presented this is implemented so that the corresponding speech input is detected by Microphone 13 and stored in Speech Memory Unit 14. If a user is now requested by Route Finder 11 to input his or her destination, then the destination stated by the user, e.g. "Berlin" or "Itzehoe", is detected by Microphone 13 and passed on to Speech Memory Unit 14. Because Route Finder 11 has either been informed of its current location or still knows it from earlier, it will first determine the corresponding route based on the desired input destination and its current location. If Route Finder 11 not only displays the corresponding route graphically, but also delivers a spoken announcement, then the string of characters stored as text for the corresponding announcement are described phonetically according to general rules and then converted to a purely synthetic form for output as speech. In the example shown in FIG. 1 the stored trains of characters are described phonetically in Converter 15 and synthesized in Speech Synthesizing Device 16, which is located directly after Converter 15.

As long as the trains of characters called up via the speech input and specified for reproduction follow the rules of phonetic transcription with respect to their pronunciation for the language in which the dialog between the user and Route Finder 11 is to be conducted, the corresponding train of characters, after being processed by Converter 15 and Speech Synthesizing Device 16, can be released into the environment via Loudspeaker 17 as a word corresponding to the phonetic conditions of the language and will also be understood as such by the environment. For a Route Finder 11 of the type described, this means that the text specified for reproduction consisting of several trains of characters and initiated via the speech input, for example "Turn right at the next intersection!" can be output and understood without any problems, i.e. in accordance with the phonetic conditions of the language, via Loudspeaker 17 as this information is not subject to any peculiarities when reproduced.

If, however, the user is to be provided an opportunity to check if the destination input is correct after having input the destination, for example, Route Finder 11 will reproduce something similar to the following sentence after the user has input the destination: "You have selected Berlin as your destination. If this is not correct, please enter a new destination now." Even if this information can be phonetically reproduced correctly according to the general rules, problems will arise when the destination is not Berlin, but Laboe instead. If the train of characters that is the textual representation of the destination Laboe is described phonetically in Converter 15 according to general rules and then placed in a synthetic form, like the rest of the information above, in Speech Synthesizing Device 16 for output via Loudspeaker 17, the final result output via Loudspeaker 17 would only be correct when the ending "oe" is always reproduced as "ö" in accordance with the general rules. In the latter case, the correctness of the reproduction of the destination Laboe will always lead to an incorrect reproduction when the user selects Itzehoe as the destination. This is because always pronouncing "oe" as "ö" would cause the destination to be reproduced phonetically as "Itzehö", which is incorrect.

To prevent this Comparator 18 is placed between Speech Synthesizing Device 16 and Loudspeaker 17. Comparator 18 is fed the actual destination spoken by the user and the train of characters corresponding to that destination after they are run through Converter 15 and Speech Synthesizing Device 16, and the two are then compared. If the synthesized train of characters matches the destination originally input by voice to a high degree of correlation (above the threshold value), then the synthesized train of characters is used for reproduction. If the degree of correlation cannot be determined, a variation of the original train of characters is created in Speech Synthesizing Device 16 and a new comparison of the destination originally input by voice and the variation created is conducted in Comparator 18.

If Route Finder 11 is trained so that as soon as a train of characters or a variation reproduced using Loudspeaker 17 matches the original to the required degree, the creation of additional variations is stopped immediately. Route Finder 11 can also be modified so that several variations are created, and the variation that best matches the original is then selected.

Figure 2A:
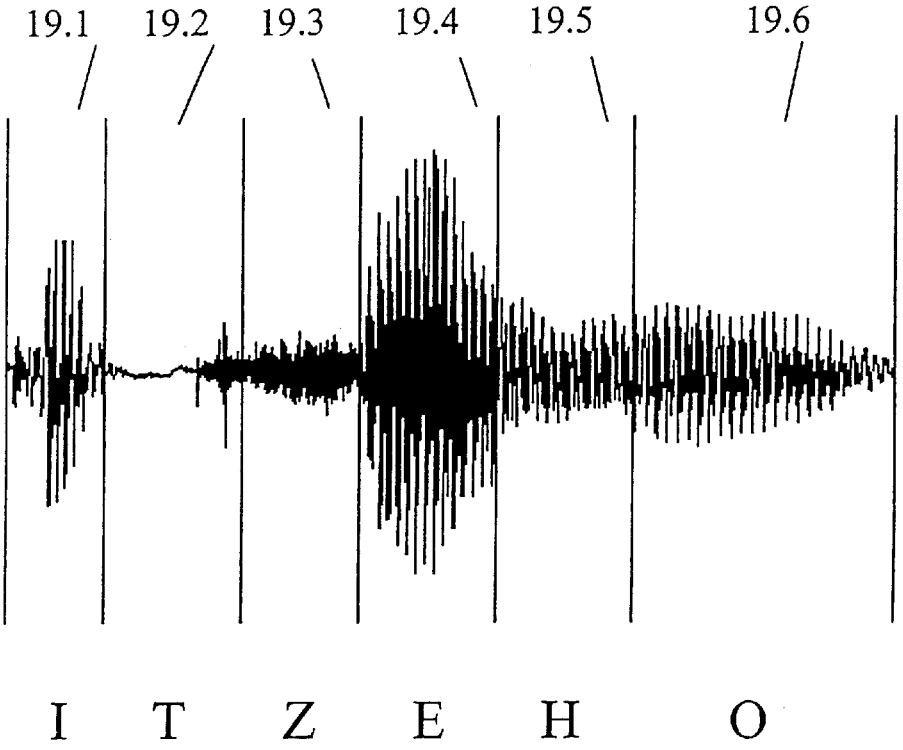
FIG. 2: A comparison of segmented utterances
Figure 2B:
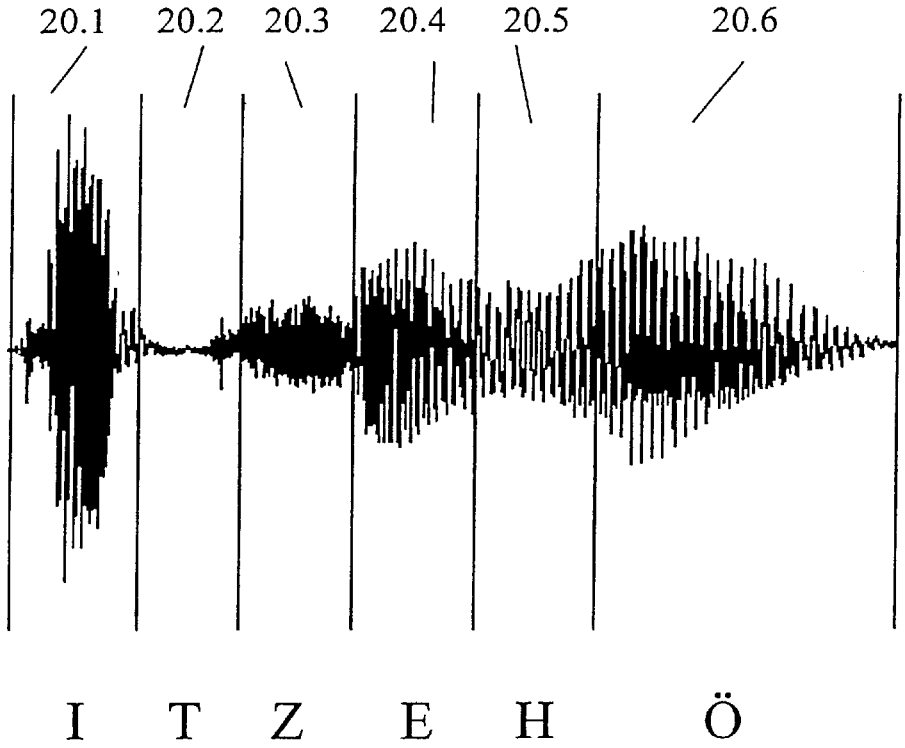

How the comparison is performed in Comparator 18 will be shown in more detail in conjunction with FIGS. 2*a* and 2*b*. FIG. 2*a* contains an illustration of the time domain of a speech signal actually spoken by a user containing the word "Itzehoe". FIG. 2*b* also shows the time domain of a speech signal for the word "Itzehoe", although in the case shown in FIG. 2*b*, the word "Itzehoe" was described phonetically from a corresponding train of characters in Converter 15 according to general rules and then placed in a synthetic form in Speech Synthesizing Device 16. It can clearly be seen in the illustration in FIG. 2*b* that the ending "oe" of the word Itzehoe is reproduced as "ö" when the general rules are applied. To rule out the possibility of incorrect reproduction, the spoken and synthesized forms are compared to each other in Comparator 18.

To simplify this comparison, the spoken as well as the synthesized form are divided into segments 19, 20 and the corresponding segments 19/20 are compared to each other. In the example shown in FIGS. 2*a* and 2*b* it can be seen that only the last two segments 19.6, 20.6 display a strong deviation while the comparison of the rest of the segment pairs 19.1/20.1, 19.2/20.2 . . . 19.5/20.5 show a relatively large degree of correlation. Due to the strong deviation in segment pair 19.6/20.6, the phonetic description in segment 20.6 is changed based on a list stored in Memory 21 (FIG. 1) that contains phonemes that are similar or a better match. As the phoneme in question is "ö" and the list of similar phonemes contains the replacement phonemes "o" and "oh", the phoneme "ö" is replaced by the replacement phoneme "o". To do this the stored train of characters is re-described phonetically in Converter 15' (FIG. 1), placed in a synthetic form in Speech Synthesizing Device 16 and then compared again with the actual spoken input destination in Comparator 18.

For the sake of completeness we would like to point out that in another example (not shown here), Converter 15' can be realized using Converter 15.

If it is shown that the degree of correlation of the correspondingly modified train of characters, also called a variation in the context of this application, to the spoken word is not above a threshold value, the method is performed again with another replacement phoneme. If the degree of correlation is above the threshold in this case, the corresponding synthesized word is output via Loudspeaker 17.

The order of the steps in the method can also be modified. If it is determined that there is a deviation between the spoken word and the original synthetic form and there are a number of replacement phonemes in the list stored in Memory 21, then a number of variations could also be formed at the same time and compared with the actual spoken word. The variation that best matches the spoken word is then output. If using a complex method to determine the correct -synthetic- pronunciation of a word is to be prevented when words that can trigger the method described above are to used more than once, then the corresponding modification can be stored with a reference to the train of characters "Itzehoe" when the correct synthetic pronunciation of the word "Itzehoe" has been determined, for example. This means that a new request for the train of characters "Itzehoe" will yield at the same time the correct pronunciation of this word while taking the peculiarities of the pronunciation that deviate from the phonetic description according to general rules into consideration, so that the comparison step in Comparator 18 can be eliminated. To make these modifications apparent, Extended Memory 22 has been drawn in using dashed lines in FIG. 1. Information referring to the modifications to stored trains of characters can be stored in the extended memory unit.

For the sake of completeness we would like to point out that Extended Memory 22 is not only limited to the storage of information regarding the correct pronunciation of stored trains of characters. For example, if a comparison in Comparator 18 shows that there is no deviation between the spoken and the synthesized form of a word or that the deviation is below a threshold value, a reference can be stored in Extended Memory 22 for this word that will prevent the complex comparison in Comparator 18 whenever the word is used in the future.

It can also be seen in FIGS. 2*a* and 2*b* that segments 19 according to FIG. 2*a* and segments 20 according to FIG. 2*b* do not have the same format. For example, segment 20.1 is wider in comparison to segment 19.1, while segment 20.2 is much narrower compared to the corresponding segment 19.2. This is due to the fact that the "spoken length" of the various phonemes used in the comparison have different lengths. However, as such differing lengths of time to speak the word cannot be ruled out, Comparator 18 is designed so that differing spoken lengths of time for a phoneme will not result in a deviation.

For the sake of completeness we would like to point out that when different segmentation methods are used for the spoken and the synthesized format, a different number of segments 19, 20 can be calculated. If this does occur, a certain segment 19, 20 does not have to be compared only to a corresponding segment 19, 20, but can also be compared to the segments before and after the corresponding segment 19, 20. This makes it possible to replace one phoneme by two other phonemes. It is also possible to utilize this process in the other direction. If no match can be found for segment 19, 20, then the segment can be excluded or replaced by two segments with a higher degree of correlation.

What is claimed is:

1. A reproduction method for voice-controlled systems with text-based speech synthesis, comprising the steps of:

converting a stored string of characters described phonetically according to general rules into a pure synthetic form;

if there is an actually spoken speech input that corresponds to said stored string of characters, comparing said pure synthetic form of said string of characters with said speech input before reproduction of said string of characters;

if a deviation is detected in said pure synthetic form of said string of characters that has a value greater than a threshold value, creating at least one variation of said pure synthetic form of said string of characters;

comparing one of said variations with said speech input; and outputting one of said variations instead of said pure synthetic form of said string of characters, if the deviation of one of said variations from said speech input is less than said threshold value.

2. A reproduction method according to claim 1, wherein one variation of the converted string of characters is created in said creating step, and wherein said creating step will be executed at least one more time to create a new variation of the converted string of characters if in said outputting step the deviation of the variation from the speech input is always above the threshold value when the two are compared.

3. A method according to claim 2, wherein before comparing the speech input with the converted string of characters of the variation created from the converted string of characters, the speech input and the converted string of characters or the variation created will be segmented.

4. A reproduction method according to claim 1, wherein at least two variations of the converted string of characters will be created in said creating step and wherein when there is more than one variation of the converted string of characters having a deviation from the speech input that is below the threshold value, the variation of the converted string of characters with the smallest deviation from the speech input will be reproduced.

5. A method according to claim 4, wherein before comparing the speech input with the converted string of characters or the variation(s) created from the converted string of characters, the speech input and the converted train of characters or the variation created will be segmented.

6. A method according to claim 1, wherein before comparing the speech input with the converted string of characters or the variation(s) created from it, the speech input and the converted train of characters or the variation(s) created will be segmented.

7. A reproduction method according to claim 6, wherein the same segmenting approach will be used to segment the speech input and the converted string of characters or the variation created from the converted string of characters.

8. A reproduction method according to claim 6, wherein different segmenting approaches will be used to segment the speech input and the converted string of characters of the variation created from the converted string of characters.

9. A reproduction method according to claim 6, wherein an explicit segmenting approach will be used to segment the converted string of characters or the variation created from the converted string of characters, and an implicit segmenting approach will be used to segment the speech input.

10. A reproduction method according to claim 6, wherein the corresponding segments of the converted string of characters provided in segmented form and of the segmented speech input will be examined for common features, and wherein the phoneme present in the segment of the converted string of characters will be replaced by a replacement phoneme when there is a deviation in two corresponding segments that is above the threshold value.

11. A reproduction method according to claim 10, wherein each phoneme is linked to at least one replacement phoneme that is similar to the phoneme.

12. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein as soon as a variation of a string of characters has been determined to be worthy of reproduction, the peculiarities arising in conjunction with the reproduction of the string of characters will be stored with a reference to the string of characters.

13. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting said at least one variation of the converting string of characters having been created instead of the converted string of characters as long as the deviation of at least one variation of the converted string of characters having been from the speech input is below the threshold value when the two are compared, and wherein before comparing the speech input with the converted string of characters or the variation created from the converted string of characters, the speech input and the converted string of characters or the variation created will be segmented, wherein the same segmenting approach will be used to segment the speech input and the converted string of characters or the variation created from the converted string of characters, wherein the corresponding segments of the converted string of characters provided in segmented form and of the segmented speech input will be examined for common features and that the phoneme present in the segment of the converted train of characters will be replaced by a replacement phoneme when there is a deviation in two corresponding segments that is above the threshold value.

14. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, wherein different segmenting approaches will be used to segment the speech input and the converted string of characters or the variation created from the converted string of characters, and wherein the corresponding segments of the converted string of characters provided in segmented form and of the segmented speech input will be examined for common features and that the phoneme present in the segment of the converted train of characters will be replaced by a replacement phoneme when there is a deviation in two corresponding segments that is above the threshold value.

15. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of said at least one variation of the converted string of characters having been from the speech input is below the threshold value when the two are compared, wherein before comparing the speech input with the converted string of characters or the variation crated from the converted string of characters, the speech input and the converted string of characters of the variation created will be segmented, wherein an explicit segmenting approach will be used to segment the converted string of characters or the variation created from the converted string of characters, and an implicit segmenting approach will be used to segment the speech input, and wherein the corresponding segments of the converted string of characters provided in segmented form and of the segmented speech input will be examined for common features and that the phoneme present in the segment of the converted train of characters will be replaced by a replacement phoneme when there is a deviation in two corresponding segments that is above the threshold value.

16. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein one variation of the converted string of characters is created by said creating step, and wherein said creating step will be executed at least one more time to create a new variation of the converted string of characters if in the outputting step the deviation of the variation from the speech input is always above the threshold value when the two are compared, and wherein as soon as a variation of a string of characters has been determined to be worthy of reproduction of the string of characters will be stored with a reference to the string of characters.

17. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein at least two variations of the converted string of characters will be created by said creating step, wherein there is more than one variation of the converted string of characters having a deviation from the speech input that is below the threshold value, the variation of the converted string of characters with the smallest deviation from the speech input will be reproduced, and wherein as soon as a variation of a string of characters has been determined to be worthy of reproduction, the peculiarities arising in conjunction with the reproduction of the string of characters will be stored with a reference to the string of characters.

18. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, and wherein as soon as a variation of a string of characters has been determined to be worthy of reproduction, the peculiarities arising in conjunction with the reproduction of the string of characters will be stored with a reference to the string of characters.

19. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, wherein the same segmenting approach will be used to segment the speech input and the converted string of characters or the variation created from the converted string of characters, and wherein as soon as a variation of a string of characters has been determined to be worthy of reproduction, the peculiarities arising in conjunction with the reproduction of the string of characters will be stored with a reference to the string of characters.

20. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, wherein different segmenting approaches will be used to segment the speech input and the converted string of characters of the variation created from the converted string of characters, and wherein as soon as a variation of a string of characters has been determined to be worth of reproduction, the peculiarities arising in conjunction with the reproduction of the string of characters will be stored with a references to the string of characters.

21. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, wherein an explicit segmenting approach will be used to segment the converted string of characters or the variation created from the converted string of characters, and an implicit segmenting approach will be used to segment the speech unit, and wherein as soon as a variation of a string of characters has been determined to be worthy of reproduction, the peculiarities arising in conjunction with the reproduction of the string of characters will be stored with a reference to the string of characters.

22. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, wherein the corresponding segments of the converted string of characters provided in segmented form and of the generated speech input will be examined for common features, wherein the phoneme present in the segment of the converted string characters will be replaced by a replacement phoneme when there is a deviation in two corresponding segments that is above the threshold value, and wherein as soon as a variation of a string of characters has been determined to be worthy of reproduction, the peculiarities arising in conjunction with the reproduction of the string of characters will be stored with a reference to the string of characters.

23. A reproduction method for voice-controlled systems with text-based speech synthesis, said reproduction method comprising the steps of:

when there is actual spoken speech input that corresponds to a stored string of characters, comparing a converted string of characters to the speech input before reproduction of the string of characters described phonetically according to general rules and converted to a purely synthetic form;

when a deviation is detected in the converted string of characters that has a value above a threshold value, creating at least one variation of the converted string of characters; and outputting at least one variation of the converting string of characters having been created instead of the converted string of characters as long as the deviation of at least one variation of the converted string of characters having been from the speech input is below the threshold value when the two are compared, wherein before comparing the speech input with the converted string of characters or the variation created from the converted string of characters, the speech input and the converted string of characters or the variation created will be segmented, wherein the corresponding segments of the converted string of characters provided in segmented form and of the generated speech input will be examined for common features, wherein the phoneme present in the segment of the converted string characters will be replaced by a replacement phoneme when there is a deviation in two corresponding segments that is above the threshold value, and wherein each phoneme is linked to at least one replacement phoneme that is similar to the phoneme, wherein as soon as a variation of a string of characters has been determined to be worthy of reproduction, the peculiarities arising in conjunction with the reproduction of the string of characters will be stored with a reference to the string of characters.

* * * * *